US005322131A

United States Patent [19]

Pressley et al.

[11] Patent Number: 5,322,131

[45] Date of Patent: Jun. 21, 1994

[54] VIBRATION-REDUCED PNEUMATIC TOOL

[75] Inventors: Jack Pressley, Hudson, Ohio; John Knott, New Hartford, N.Y.; David M. Young, Frankfort, N.Y.; Pradip K. Paul, Whitesboro, N.Y.; Richard Wilusz, Utica, N.Y.

[73] Assignee: Chicago Pneumatic Tool Company, Utica, N.Y.

[21] Appl. No.: 64,449

[22] Filed: May 20, 1993

[51] Int. Cl.[5] ..... B25D 9/04

[52] U.S. Cl. ..... 173/162.1; 173/17

[58] Field of Search ..... 173/162, 162.1, 162.2, 173/13, 15, 17, 128, 132

[56] References Cited

U.S. PATENT DOCUMENTS

| | | | |
|---|---|---|---|
| 1,792,894 | 2/1931 | Collins | 173/162 |
| 1,804,712 | 5/1931 | Stevens | 173/162.1 |
| 2,019,964 | 11/1935 | Hamerly . | |
| 2,058,583 | 10/1936 | Fonss | 173/162.2 |
| 2,500,036 | 3/1950 | Horvath . | |
| 2,899,934 | 8/1959 | Salengro . | |
| 3,920,086 | 11/1975 | Goppen et al. | 173/162 |
| 3,968,843 | 7/1976 | Shotwell . | |
| 4,921,053 | 5/1990 | Dobry et al. . | |
| 5,050,689 | 9/1991 | Dobry et al. . | |
| 5,052,499 | 10/1991 | Dobry et al. . | |
| 5,054,562 | 10/1991 | Honsa et al. | 173/162.1 X |

FOREIGN PATENT DOCUMENTS

| | | | |
|---|---|---|---|
| 927903 | 6/1963 | United Kingdom | 173/162.1 |

*Primary Examiner*—Rinaldi I. Rada

*Attorney, Agent, or Firm*—Schmeiser, Morelle & Watts

[57] ABSTRACT

The invention is a pneumatic impact hammer in which the vibrations created in the motor portion of the tool are substantially reduced prior to reaching the tool's handle portion. The motor portion is allowed to move relative to the tool's handle portion and is located within a handle-attached cylindrical housing. Low-friction plastic bearings are located between the motor portion and the surrounding housing. The cycling valve that controls the reciprocating movement of the tool's piston is attached to the motor and receives air from a flexible air inlet tube that is slidably engaged to the motor and is secured to the tool's handle portion.

19 Claims, 1 Drawing Sheet

VIBRATION-REDUCED PNEUMATIC TOOL

FIELD OF THE INVENTION

The invention is in the field of power tools. More particularly, the invention is a pneumatic chipping hammer that includes a number of components designed to reduce the transfer of vibration from the tool's motor portion to the operator. The tool's motor portion is movable within an outer housing through the use of a flexible isolator and low-friction slidable bearings. A flexible air tube is located within the tool and is used to connect the tool's air inlet to the tool's motor portion.

BACKGROUND OF THE INVENTION

A pneumatic tool such as an air hammer normally comprises three combined sections. The first section includes the tool s air inlet and usually also includes a handle for the manual manipulation of the tool. The tool's second section contains the air-powered motor. The third section of the tool comprises a retainer that removably secures a bit/work-contacting implement to a distal end of the tool.

To operate the tool, a user grasps the tool's handle and then actuates a trigger mechanism that causes a valve to allow pressurized air to flow to the tool's motor. In the case of a pneumatic hammer, the air-powered motor includes an elongated cylinder that houses a piston. The acceleration forces associated with the pressurized air that cause the reciprocating movement of the piston, also cause movement (vibration) of the cylinder and attached handle generally at a frequency of 20 to 40 cycles per second.

Furthermore, when the piston contacts the working implement, a large impact occurs which also creates a strong vibration which is transferred through the tool. The impact induced vibration commonly excites other components of the tool so that they vibrate at their natural frequencies which frequencies are generally higher than the fundamental operating frequency of the tool which may be termed impacts or blows per minute. Since the tool operates at a relatively high speed, the operator often finds the strong and seemingly continuous vibrations which are not only uncomfortable but tiring.

In the past, a large number of inventors have tried to create pneumatic tools in which the severity of the transmitted vibrations are reduced. The modified tools normally include some form of spring or air cushion that functions to absorb the created vibrations before they can be transmitted to the operator. To the extent that any of these versions are effective in reducing vibration, they generally do so at only the higher frequencies which are the vibrations created due to impact and thus do not isolate the vibrations at the tool components fundamental frequencies. Also, the prior art tools are usually quite complicated, expensive to produce and have a less than optimum durability.

SUMMARY OF THE INVENTION

The invention is a pneumatic tool that includes a number of components designed to reduce the amount of vibration transmitted to an operator. The tool includes a handle portion that is connected to, but substantially isolated from, a motor portion.

A vibration isolator is located between the tool's handle and motor portions. The isolator connects one end of the tool's motor portion to an interior surface of the handle portion and allows relative motion between the two portions.

A plurality of non-metallic bearings are located between side portions of the motor and an exterior, handle-attached housing. The bearings are located within complementary grooves that guide the longitudinal movement of the motor within the housing and prevent relative rotation. The bearings are made of a plastic, low-friction material that enables the motor portion to slide within the housing in a substantially frictionless manner. The plastic material of the bearings also aids in the elimination of transmitted vibrations between the two separated portions of the tool.

In the invention, an air cycling valve moves with the tool's motor portion. To deliver air to the motor portion, a flexible air supply tube is employed to extend between the tool's motor and handle portions. The tube is made of a low friction material and is slidably received within a seal located in an opening in the tool's motor portion. This combination of elements maintains the integrity of the air supply to the motor portion and compensates for any sideways misalignment between the motor portion and outer housing. In addition, the tube substantially eliminates the transmission of vibration to the handle via the motor's air supply.

A secondary air shut-off mechanism is located on the tool's motor portion and is capable of stopping the air flow to the tool's motor portion. The mechanism is actuated when the bit/work-contacting implement is not fully secured to the tool by the retainer mechanism.

DETAILED DESCRIPTION OF THE DRAWINGS

Figure 1:
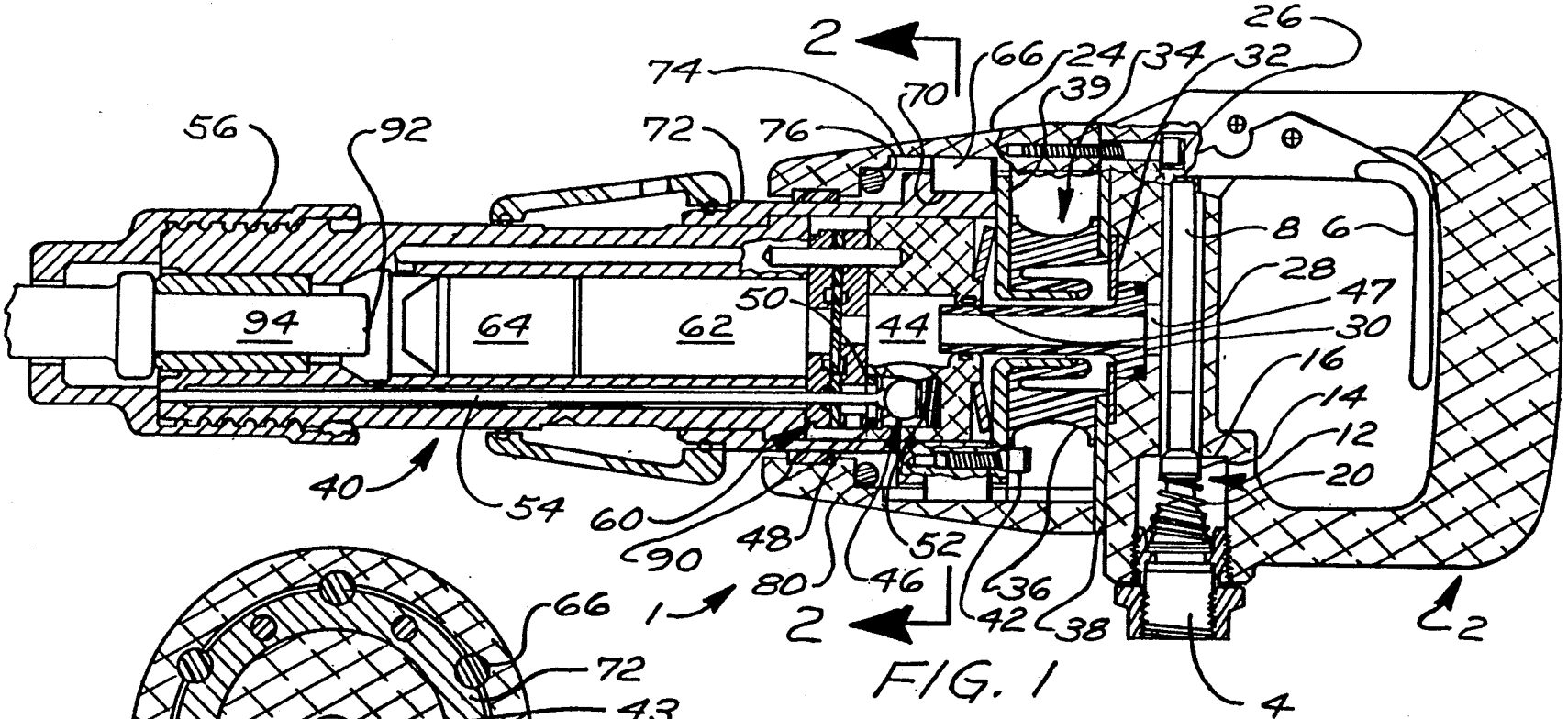
FIG. 1 is a side, cross-sectional and partial cutaway view of a pneumatic chipping hammer in accordance with the invention.
Figure 2:
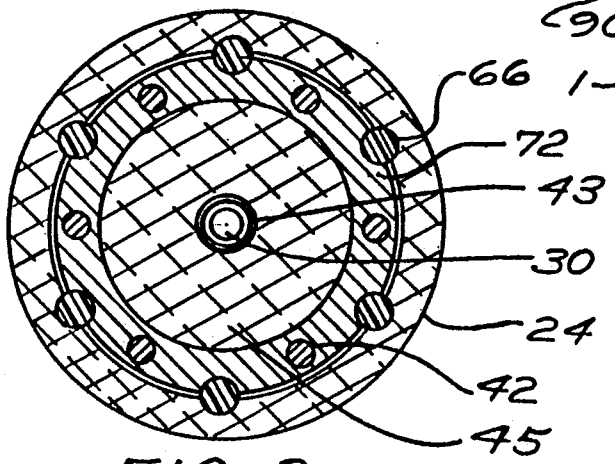
FIG. 2 is a cross-sectional view of the hammer shown in FIG. 1 taken along the plane indicated at 2—2.

Referring now to the drawings in greater detail, wherein like reference characters refer to like parts throughout the several figures, there is shown by the numeral 1 an air-powered impact hammer in accordance with the invention.

The hammer includes a handle portion 2 and an air inlet passage 4. Located within the inner perimeter of the handle portion is a manually actuable trigger 6. The trigger is connected to a throttle rod 8 that rides within a bushing 9. The throttle rod 8 controls a throttle valve 12.

The throttle valve 12 is in the air flow-path within the interior of the tool and is capable of stopping the air flow through passage 4. The valve's head 14 is located at the end of the throttle rod and the valve's seat 16 is located on the sidewall of the surrounding passageway. A spring 20 biases the throttle valve toward a closed position.

The distal part of the handle portion has a shape designed to facilitate an operator's handling of the tool. The forward part of the handle portion includes a cylindrical casing/housing 24 that is attached to the handle portion's distal part by six cap screws 26 (shown in a partial cutaway in FIG. 1). In the preferred embodiment, the shaped distal part of the handle and the attached cylindrical casing are made of a lightweight metallic material such as aluminum.

The air path extends through the handle portion via passage 28 and then continues into an air inlet tube 30. The tube 30 is preferably made from flexible plastic material such as TEFLON brand of Low-friction plastic material or polyurethane or from a rubber material. The air tube is secured to the handle by a washer 32 that is sandwiched between the handle and a vibration isolator 34.

The isolator 34 is secured to the handle by the same screws 26 that attach the handle's distal part to the casing. The isolator includes a flexible central portion 36 that is sandwiched between and bonded to upper and lower metal plates, 38 and 39 respectively.

The lower plate of the isolator is secured to the tool's motor portion 40 by a plurality of screws 42 (shown in a partial cutaway in FIG. 1). The air flow-path continues through the tube 30 and into the motor portion via a front opening 43 in chamber 44. The chamber is within a block 45 that is secured to the motor portion and includes a seal 47 that encircles and forms a seal about the end of the tube 30. The seal, in combination with the low-friction material of the air tube 30, maintains the integrity of the air supply to the motor portion and also reduces transmission of motor acceleration forces to the handle due to friction between the sliding tube and the seal.

As the air exits chamber 44, it goes into and through a secondary air shut-off valve 46. Valve 46 comprises a ball 48 that is biased toward a circular seat 50 by a spring 52. A pushrod 54 contacts the ball and maintains it off the seat as long as the tool's bit/implement retainer 56 is in its normal operative position. If the retainer is moved away from the motor portion, the pushrod follows it and allows the ball to move onto the seat thereby shutting off the flow of air through the motor portion's air flow-path.

The air flow-path continues past valve 46 and into the tool's diaphragm or cycling valve 60. The cycling valve is basically of the standard type for pneumatic impact tools and functions to direct high pressure air into the cylinder 62 either above the piston 64 (causing a downward force on the piston) or into a passage (not shown) that leads to a port in the cylinder below the piston (causing an upward force on the piston). In this manner, the valve directs the air to cause a reciprocating motion of the piston within the cylinder. It should be noted that the cylinder is within and coaxial with the handle-attached cylindrical casing/housing 24.

As described above, the piston and cylinder form the impacter portion of the tool. When combined with the cycling valve 60 and the related passage(s) that direct the air to the different portions of the cylinder, the motor portion of the tool is defined. In the preferred embodiment shown, the motor portion is allowed to move longitudinally within the outer, handle-attached casing/housing 24.

To enable a relatively friction-free movement of the tool's motor portion within the casing/housing 24, a plurality of drum-shaped bearings 66 are employed. These bearings are evenly spaced about the outer circumference of the cylinder and are retained within shaped slots 70 located in the outer wall of an adaptor 72 that retains the cylinder 62. The bearings are designed to slide within complementary grooves 74 on the inner wall of the casing 24. The bearings are preferably made of a non-metallic, low-friction plastic material such as TEFLON or RULON. The bearings not only allow virtually free sliding between the motor and handle portions of the tool but, by virtue of the complementary slots 70 and grooves 74, the bearings prevent relative rotation between the motor and the surrounding casing 24. In addition, the plastic material of the bearings helps to prevent transmission of impact-created vibrations into the casing.

The motor is normally limited in the distance of travel within the casing by the isolator 34 and by a shoulder 76 located on the interior surface of the casing. A rubber buffer ring 80 is located in front of the shoulder. A rider ring 90 made of a low-friction type plastic material such as TEFLON is located at the base of the casing and contacts the motor portion to further complement the guiding action of the bearings for the motor portion's travel within the casing.

In operation, whenever the piston 64 reaches the bottom of cylinder 62, it encounters the head 92 of a bit/work-contacting implement 94. The implement is removable from the tool and is normally held in place by a retainer 56 that is threadably engaged to the bottom of the cylinder. The bit/implement 94 can be a chisel, hammer, punch or other well-known implement used to impart an impact force. The vibrations created by the impact and motor vibrations resulting from piston acceleration forces are counteracted by the isolator 34. The vibrations are substantially isolated from the tool's handle portion by the bearings 66, flexible air tube 30 and the isolator 34.

The primary embodiment of the invention disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. An improved tool of the type having a pneumatically-powered motor that includes a piston within a cylinder, a throttle valve in an air inlet passage leading to the motor, a handle and a movable implement retainer, the improvement comprising:

a flexible member that attaches the motor to the handle in a manner wherein the motor can move relative to the handle;

an elongated, normally straight air tube that is made of a flexible, non-metallic material, said air tube forming an extension of an air passageway that is located in a portion of the tool attached to said handle, said air tube having the function of supplying air to the tool's motor and wherein said air tube extends through a seal located in a shaped opening in said motor and is capable of flexing if said motor should move in a lateral direction relative to a longitudinal axis of said air tube; and a plurality of bearings located between the motor and an exterior cylindrical casing that is attached to the handle.

2. The tool of claim 1 wherein the flexible air tube is secured to the handle and has one end slidably located within an opening in the motor.

3. The tool of claim 1 wherein the bearings are made of a non-metallic material that is capable of damping any vibrations that pass through the bearings.

4. The tool of claim 1 wherein the bearings are secured to the motor and slide within grooves located on an interior surface of the casing.

5. An improved tool of the type having a pneumatically-powered motor that includes a piston within a cylinder, a throttle valve in an air inlet passage leading to the motor, a handle and a movable implement retainer, the improvement comprising:

a flexible member that attaches the motor to the handle in a manner wherein the motor can move relative to the handle;

a flexible air tube that extends between the motor and an air inlet associated with the handle;

a plurality of bearings located between the motor and an exterior cylindrical casing that is attached to the handle; and a secondary air shut-off means attached to the motor and capable of stopping the flow of air to the motor if the retainer moves from a first position to a second position.

6. A power tool comprising:

a handle portion;

a hollow cylindrical housing secured to one of the handle portion;

an impacter portion located at least partially within said housing, said impacter portion including a hollow cylinder and a piston adapted for reciprocating travel within said cylinder and wherein said impacter portion is operatively secured to said handle portion and is adapted to move relative to said housing;

bearing means located between the impacter portion and the housing, said bearing means functioning to guide the impacter portion when said impacter portion moves relative to the housing and wherein said bearing means is in the form of a plurality of separate, spaced drum-shaped bearings made of a non-metallic material capable of substantially friction-free sliding; and a retainer means located at one end of said impacter portion, said retainer means functioning to releasably retain an implement to the tool's impacter portion in a manner wherein said implement can be acted upon by the piston.

7. The tool of claim 6 wherein the bearings are operatively secured to one of either the impacter portion or the housing and wherein the bearings are adapted to slide within grooves that are complementary in shape to the bearings and are located on the other one of either the impacter portion or the housing and wherein the grooves guide the impacter portion to move in an axial direction and prevent the impacter portion from being rotated relative to the housing.

8. The tool of claim 6 wherein the bearings of the bearing means are made of TEFLON material.

9. The tool of claim 6 wherein the piston is caused to move by air power and wherein the impacter portion includes an attached cycling valve that functions to direct inputted air into the cylinder at a point either above or below the piston to cause said reciprocating movement of the piston.

10. The tool of claim 9 wherein the handle portion includes an air inlet and an attached flexible air tube that is operatively connected to the air inlet and functions to direct inputted air to the cycling valve and wherein the air tube slidably fits within a shaped opening on the tool's impacter portion.

11. A power tool comprising:

a handle portion;

a hollow cylindrical housing secured to one end of the handle portion;

an impacter portion located at least partially within said housing, said impacter portion including a hollow cylinder and a piston adapted for reciprocating travel within said cylinder and wherein said impacter portion is operatively secured to said handle portion and is adapted to move relative to said housing;

bearing means located between the impacter portion and the housing, said bearing means functioning to guide the impacter portion when said impacter portion moves relative to the housing and wherein said bearing means is in the form of a plurality of separate, spaced bearings made of a non-metallic material capable of substantially friction-free sliding;

a retainer means located at one end of said impacter portion, said retainer means functioning to releasably retain an implement to the tool's impacter portion in a manner wherein said implement can be acted upon by the piston; and an air shut-off means attached to the impacter portion, said air shut-off means comprising a rod slidably secured to the impacter portion and having one end designed to contact the retainer means and an opposite end designed to contact a secondary valve that is movable with the impacter portion and is located in an air flow path that leads to the cycling valve wherein if the retainer means moves from a first position to a second position, the rod is caused to move from a first position to a second position and wherein when said rod is in said second position, the rod causes the secondary valve to prevent any flow of air to the cycling valve.

12. A pneumatic power tool comprising:

a handle portion;

a hollow cylindrical housing attached to said handle portion;

a motor portion located at least partially within said housing, said motor portion having a hollow cylinder and a piston adapted for reciprocating travel within said cylinder and wherein said motor portion is movably secured to said handle portion and is adapted to move relative to said housing and wherein the motor portion further includes an attached cycling valve that functions to direct inputted air into the cylinder at a point either above or below the piston to cause said reciprocating movement of the piston;

a flexible air tube secured to said handle portion and operatively connected to an air inlet located in the handle portion, said flexible air tube functioning to direct inputted air to the cycling valve to the motor portion and wherein the air tube is slidably located within a shaped opening in the tool's motor portion;

bearing means located between the motor portion and the housing, said bearing means functioning to guide the motor portion when said motor portion moves relative to the housing and wherein the bearing means is in the form of a plurality of separate, drum-shaped bearings that are made of a non-metallic material that allows a substantially friction-free sliding movement of the motor portion within said hollow cylindrical housing; and a retainer means located at one end of said motor portion, said retainer means functioning to releasably retain an implement to the tool's motor portion in a manner wherein said implement can be acted upon by the piston.

13. The tool of claim 12 wherein the flexible air tube is made of a rubber material.

14. The tool of claim 12 wherein the flexible air tube is made from a plastic material.

15. The tool of claim 12 wherein the bearings are operatively secured to one of either the motor portion or the housing and wherein the bearings are adapted to slide within grooves that are complementary in shape to the bearings and are located on the other one of either the motor portion or the housing and wherein the grooves guide the motor portion to move in an axial direction and prevent the motor portion from being rotated relative to the housing.

16. The tool of claim 12 wherein the bearings of the bearing means are made of TEFLON material.

17. A pneumatic power tool comprising:

a handle portion;

a hollow cylindrical housing attached to said handle portion;

a motor portion located at least partially within said housing, said motor portion having a hollow cylinder and a piston adapted for reciprocating travel within said cylinder and wherein said motor portion is movably secured to said handle portion and is adapted to move relative to said housing and wherein the motor portion further includes an attached cycling valve that functions to direct inputted air into the cylinder at a point either above or below the piston to cause said reciprocating movement of the piston;

a flexible air tube secured to said handle portion and operatively connected to an air inlet located in the handle portion, said flexible air tube functioning to direct inputted air to the cycling valve of the motor portion and wherein the air tube is slidably located within a shaped opening in the tool's motor portion;

bearing means located between the motor portion and the housing, said bearing means functioning to guide the motor portion when said motor portion moves relative to the housing;

a retainer means located at one end of said motor portion, said retainer means functioning to releasably retain an implement to the tool's motor portion in a manner wherein said implement can be acted upon by the piston; and an air shut-off means attached to the motor portion, said air shut-off means comprising a rod slidably secured to the motor portion and having one end designed to contact the retainer means and an opposite end designed to contact a secondary valve that is movable with the motor portion and is located in an air flow path that leads to the cycling valve wherein if the retainer means moves from a first position to a second position, the rod is caused to move from a first position to a second position and wherein when said rod is in said second position, the rod causes the secondary valve to prevent any flow of air to the cycling valve.

18. The tool of claim 17 wherein the flexible air tube is made from a plastic material.

19. The tool of claim 17 wherein the bearing means is in the form of a plurality of separate bearings that are made of a non-metallic material that allows a substantially friction-free sliding movement of the motor portion within said hollow cylindrical housing.

* * * * *